US006852678B2

(12) United States Patent
Ojima et al.

(10) Patent No.: US 6,852,678 B2
(45) Date of Patent: Feb. 8, 2005

(54) WATER-BASED LUBRICANTS CONTAINING SULFUR AS A COORDINATING ATOM AND USES THEREOF

(75) Inventors: Heijiro Ojima, Kariya (JP); Masahiko Takeuchi, Toyota (JP); Fumio Ikesue, Toyota (JP); Noritoshi Kaskimura, Toyota (JP); Fumio Kawahara, Toyota (JP); Mitsuru Tomono, Toyota (JP)

(73) Assignees: MEC International Corporation, Toyota (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/988,401

(22) Filed: Nov. 19, 2001

(65) Prior Publication Data

US 2002/0111278 A1 Aug. 15, 2002

Related U.S. Application Data

(63) Continuation of application No. 09/308,383, filed as application No. PCT/JP97/04197 on Nov. 18, 1997.

(30) Foreign Application Priority Data

Nov. 18, 1996 (JP) ..... 8-306910

(51) Int. Cl.[7] ..... C01M 135/00

(52) U.S. Cl. ..... 508/243; 508/250; 508/257; 508/363; 508/366; 508/369; 508/371; 508/379; 508/500; 508/501; 508/567

(58) Field of Search ..... 508/243, 250, 508/257, 363, 371, 366, 369, 379, 500, 501, 567; 556/13, 19

(56) References Cited

U.S. PATENT DOCUMENTS

| | | | | |
|---|---|---|---|---|
| 3,004,056 | A | | 10/1961 | Nunn, Jr. et al. |
| 3,004,057 | A | | 10/1961 | Nunn, Jr. |
| 3,249,538 | A | | 5/1966 | Freier |
| 3,829,506 | A | | 8/1974 | Schmolka et al. |
| 3,833,502 | A | | 9/1974 | Leary et al. |
| 3,933,658 | A | | 1/1976 | Beiswanger et al. |
| 3,970,569 | A | | 7/1976 | Sturwold et al. |
| 4,138,346 | A | | 2/1979 | Nassry et al. |
| 4,151,099 | A | | 4/1979 | Nassry et al. |
| 4,199,381 | A | | 4/1980 | Nuss et al. |
| 4,253,975 | A | | 3/1981 | Law et al. |
| 4,289,547 | A | | 9/1981 | King et al. |
| 4,654,155 | A | | 3/1987 | Kipp et al. |
| 4,831,171 | A | | 5/1989 | Bergfeld et al. |
| 5,124,308 | A | | 6/1992 | Albin et al. |
| 5,385,954 | A | * | 1/1995 | Palazzotto et al. ..... 522/29 |

FOREIGN PATENT DOCUMENTS

| | | | |
|---|---|---|---|
| DE | 3524629 | A1 | 1/1987 |
| EP | 0 061 823 | A1 | 10/1982 |
| EP | 0 398 201 | A1 | 11/1990 |
| JP | 38-8117 | B1 | 6/1963 |
| JP | 47-45487 | B1 | 11/1972 |
| JP | 50-062207 | A | 5/1975 |
| JP | 53-32274 | A | 3/1978 |
| JP | 56-034796 | A | 4/1981 |
| JP | 57-167397 | A1 | 10/1982 |
| JP | 58-063794 | A | 4/1983 |
| JP | 61-291591 | A | 12/1986 |
| JP | 62-072692 | A | 4/1987 |
| JP | 3-246272 | A | 11/1991 |
| JP | 04-239096 | A | 8/1992 |
| JP | 07-118283 | A | 5/1995 |
| JP | 07-118682 | A | 5/1995 |

OTHER PUBLICATIONS

English translation of International Preliminary Examination Report (IPER).
English translation of Annexes to IPER—Article 34 Amendments (first submission).
English translation of Annexes to IPER—Article 34 Amendments (second submission).
J. A. Schey, *Tribology in Metalworking, Friction, Lubrication and Wear*, 4.7.8 Phosphate Coatings, pp. 175–178 (1983).

* cited by examiner

*Primary Examiner*—Cephia D. Toomer
(74) *Attorney, Agent, or Firm*—Burns, Doane, Swecker & Mathis, L.L.P.

(57) ABSTRACT

An aqueous lubricant is provided which by simple application onto metal surfaces forms lubricating films required for heavy working of metals, and which contains no oil. The aqueous lubricant is prepared by suspending or dispersing a metal chelate compound in water with a surfactant or the like. The metal chelate compound has a polydentate or multidentate chelate ligand, in which at least one of the coordinating atoms is sulfur, coordinated to the coordination site of at least one metal species selected from among zinc, manganese, iron, molybdenum, tin and antimony. When applied onto metal surfaces, the aqueous lubricant forms effective lubricating films on the metal surfaces. The lubricating films contain sulfur as coordinating atoms and therefore, extreme pressure produces sulfur radicals through decomposition by tribo-chemical reactions. The sulfur radicals are highly reactive and react rapidly with the metal surface to produce metal sulfides with a lubricating effect. The sulfur radicals also react with metal ions produced by decomposition of the metal chelate compound, also producing metal sulfides with a lubricating effect. The aqueous lubricants thus exhibit a satisfactory lubricating effect.

40 Claims, No Drawings

WATER-BASED LUBRICANTS CONTAINING SULFUR AS A COORDINATING ATOM AND USES THEREOF

This application is a continuation of U.S. application Ser. No. 09/308,383, filed Jul. 1, 1999, which was a national stage filing under 35 U.S.C. 371 of International Application No. PCT/JP97/04197 filed on Nov. 18, 1997, which International Application was published by the International Bureau on May 28, 1998.

TECHNICAL FIELD

The present invention relates to aqueous lubricants that are coated onto either the surface of a metal material or the molding surface of a metal mold, or both, to form a lubricating film on the metal surface, so that friction between the material and the mold is reduced, thereby enabling satisfactory plastic working of the metal. The present invention further relates to methods of using the aqueous lubricant and to chemical substances that are particularly suited for production of the aqueous lubricant.

BACKGROUND ART

When a metal material is subjected to plastic working, such as forging, extrusion, drawing, rolling or pressing, a lubricant film must be disposed on the surface of the metal material and/or the molding surface of the metal mold to reduce friction between the material and the mold and the prevent the generation of drag, seizures and the like.

In most cases, the metal is immersed in a zinc phosphate solution to produce a zinc phosphate or iron phosphate chemical film (hereafter referred to as "phosphate film") on the surface, and then further immersed in a sodium soap or the like to produce a metallic soap layer on the surface. This process creates a surface protective layer of satisfactory quality, and allows heavy working (meaning working of material surfaces with large elongation rates). However, this process requires washing treatments with cold water, hot water or acid, as well as different types of equipment. Such treatments also require long periods of time, thus lengthening the lead time. Usually, 30 minutes or longer is necessary to complete a series of treatments. It is also necessary to accomplish a single surface treatment of the entire portion of the metal that is subjected to plastic working in a subsequent step during the treatment time, and therefore this process is not suitable for production of small, sundry products.

In order to overcome these problems, the use of working oils has been proposed. For example, Japanese Laid-Open Patent Publication No. 7-118682 teaches a working oil prepared by dispersing in a mineral oil a zinc or molybdenum salt, such as zinc dithiophosphate, molybdenum dithiocarbamate or the like, which has been rendered lipophilic by the introduction of a higher alkyl group. This working oil solves most of the aforementioned problems, but because the main component is oil, it creates problems, such as contamination due to adhesion of the oil to surrounding machines and generation of oil mist. In other words, contamination of the working environment is unavoidable. A number of other problems also remain, such as the need to degrease the material surface after plastic working.

DISCLOSURE OF THE INVENTION

The present invention overcomes the problems mentioned above, and allows formation of lubricating films on surfaces by application of aqueous lubricants containing no oil.

Because no oil is used, the problems of working environment contamination and the need for subsequent degreasing treatment are solved. Because a simple application is sufficient, a solution is also provided to the problems of large equipment requirements and the need to accomplish simultaneous treatment of large volumes of materials.

The invention according to one aspect thereof relates to the aqueous lubricant itself, in which the aqueous lubricant comprises a metal chelate compound suspended or dispersed in water. The metal chelate compound described herein comprises a polydentate or multidentate chelate ligand in which at least one of the coordinating atoms is sulfur, coordinated to a coordination site of at least one metal species selected from among zinc, manganese, iron, molybdenum, tin and antimony. For the purposes of this explanation, the term "suspension" is intended to mean a metal chelate compound distributed in water, for example, by continuous stirring. The term "dispersion" is intended to mean a metal chelate compound distributed in water without precipitation, by use of a surfactant or the like. Anionic and non-ionic surfactants are suitable for dispersion of the metal chelate compounds in water.

The metal may have multiple coordination sites and the chelate ligand may be coordinated to all the multiple coordination sites. Alternatively, the chelate ligand may be coordinated to only some of the multiple coordination sites, thereby allowing coordination of a species other than the chelate ligand to the remaining coordination sites. The lubricant can be produced by dispersing the prepared metal chelate compound in water, or it may be produced by adding the chelate ligand to an aqueous solution containing a metal salt. The metal species may be any of one or more desired species, and a greater number of species will expand the range of workable conditions and workable metals.

The aqueous lubricant is applied onto the surface of a metal material and/or the molding surface of a metal mold to form an effective lubricating film on the metal surface. Because the lubricating film has sulfur as a coordinating atom, extreme pressure produces sulfur radicals through decomposition by friction or tribo-chemical reactions. The sulfur radicals are highly reactive, and react rapidly with the metal surface to produce metal sulfides, which have a lubricating effect. The sulfur radicals also react with the metal ions (one or more selected from among zinc, manganese, iron, molybdenum, tin and antimony) produced by decomposition of the metal chelate compound, also producing metal sulfides having a lubricating effect. The aqueous lubricant thus exhibits a satisfactory lubricating effect.

The invention according to another aspect thereof relates to chemical substances particularly suited for production of the aqueous lubricant. The chemical substances are multi-ligand metal chelate compounds, in which a polydentate or multidentate chelate ligand having sulfur as at least one of the coordinating atoms coordinates by partially filling the multiple coordination sites of the one or more metal species selected from among zinc, manganese, iron, molybdenum, tin and antimony, whereas ligands that do not have sulfur as a coordinating atom coordinate to the remaining coordination sites. That is, the chelate ligand is characterized as having sulfur as a coordinating atom that does not fill all the coordination sites of the metals, so that it is not coordinated to some of the coordination sites. When the multi-ligand metal chelate compound is used as an aqueous lubricant suspended or dispersed in water, a very satisfactory lubricating film is produced.

The invention according to another aspect thereof also relates to a chemical substance particularly suited for production of the aqueous lubricant. The chemical substance is characterized in that a chelate ligand having sulfur as a coordinating atom is coordinated to some of the multiple coordination sites of the metal, whereas a hydroxide ion, condensed phosphate, polycarboxylic high molecular activator and/or polyoxycarboxylic acid are coordinated to the remaining coordination sites.

In the multi-ligand metal chelate compound, a chelate ligand having sulfur as a coordinating atom is strongly coordinated with the metal, and a hydroxide ion, condensed phosphate, polycarboxylic high molecular activator and/or polyoxycarboxylic acid are weakly coordinated with the metal via oxygen anions. When the multi-ligand metal chelate compound is used as an aqueous lubricant suspended or dispersed in water, a very satisfactory lubricating film is produced.

The aqueous lubricant according to another aspect thereof has a soluble condensed phosphate salt, a soluble polycarboxylic high molecular activator and/or a soluble polyoxycarboxylic acid salt added to the aforementioned aqueous lubricant. Addition of these adjuvants improves the performance of the lubricating film. A soluble condensed phosphate salt will associate with the surfactant present in the system, thus increasing the dispersability of the metal chelate compound that forms hydrophobic fine particles. A soluble polycarboxylic high molecular activator or soluble polyoxycarboxylic acid salt will increase the adhesion of the lubricating film to the metal surface. Using an aqueous lubricant containing such adjuvants will allow more intense heavy working.

The invention according to another aspect thereof relates to a process of forming a lubricating film on a phosphate film using an aqueous solution, if the phosphate film had already been formed on a metal surface. In this process, a metal material on which the phosphate film has already been formed is immersed in an aqueous solution of a multidentate or polydentate chelate ligand having sulfur as at least one of the coordinating atoms, so that the chelate ligand reacts with the zinc ion and/or iron ion in the phosphate film to produce a crystalline multi-ligand metal chelate compound on the phosphate film. This process takes advantage of both the lubricating effect of the phosphate film and the lubricating action of the metal chelate compound, in which sulfur is a coordinating atom chelated to the zinc ion and/or iron ion.

The invention according to another aspect thereof also relates to a process of forming a lubricating film on a phosphate film. In this process, the phosphate film is formed on a metal material and the metal material is then immersed in an aqueous lubricant according to other aspects of the invention. A ligand, which is not a ligand having sulfur as a coordinating atom, reacts with the zinc ion and/or iron ion in the phosphate film to produce a crystalline polynuclear metal chelate compound on the phosphate film. This process takes advantage of both the lubricating effect of the phosphate film and the lubricating action of the metal chelate compound, in which sulfur is a coordinating atom chelated to a metal.

The invention according to another aspect thereof relates to a method of using the aqueous lubricant, in which prior to plastic working of the metal material, an aqueous lubricant according to other aspects of the invention is applied onto either or both surfaces of the metal material and the molding surface of the metal mold to form lubricating films on those surfaces, thus allowing plastic working of the metal material with a lubricating film formed on the surface.

The invention will be more fully appreciated in light of the explanation that follows.

BEST MODE FOR PRACTICING THE INVENTION

First, an embodiment of a metal chelate compound will be explained in which at least one metal species selected from among zinc, manganese, iron, molybdenum, tin and antimony is chelated and at least one of the coordinating atoms is sulfur. Chemical structures 1–28 below are examples of such metal chelate compounds, and the chelate ligands in chemical structures 1–28 (the compounds adjacent to M in the structures) react with the above-mentioned metal ions in aqueous solution or in water or organic solvents (alcohols, ketones and dioxane) to produce crystalline precipitates that are insoluble in water. The coordinated structures of the crystalline precipitates are shown in chemical structures 1 through 28. The crystalline precipitates produced thereby are metal chelate compounds. The crystalline precipitated metal chelate compounds are made minute and one, two or more different metal chelate compounds are suspended or dispersed in water to generate aqueous lubricants.

In the structures, M represents divalent zinc, divalent or trivalent manganese, divalent or trivalent iron, trivalent, tetravalent or pentavalent molybdenum, divalent $[(MoOS)_2]^{2+}$, divalent $[Mo_2S_4]^{2+}$, divalent or tetravalent tin, trivalent or pentavalent antimony, divalent MoO or monovalent MoOS.

In chemical structures 1–12, 15, 16, 18, 19 and 28, n varies depending on the M species. For example, when M is zinc, tin or antimony, n=1 or 2; when M is manganese or iron, n=1, 2 or 3; and when M is molybdenum, n=1 or 2. In the case of zinc, for example, if n=1, the chelate ligand having sulfur as a coordinating atom only coordinates with two of the four coordination sites of zinc. In this case, the two remaining coordination sites coordinate with a chelate ligand that does not have sulfur as a coordinating atom, such as a hydroxide ion, condensed phosphate, polycarboxylic high molecular activator and/or polyoxycarboxylic acid. Generally, this means that when the number of coordination sites of the metal M in the following chemical structures cannot be filled by a chelate ligand having sulfur as a coordinating atom, a chelate ligand containing no sulfur, such as hydroxide ion, condensed phosphate, polycarboxylic high molecular activator and/or polyoxycarboxylic acid, coordinates to the coordination sites of the metal that are not coordinated with the chelate ligand having sulfur as a coordinating atom.

[Chemical formula 1]

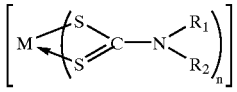

wherein $R_1$ and $R_2$ may be the same group, in which case $R_1$ (=$R_2$) is H, —$CH_3$, —$C_2H_5$, —$C_3H_7$ (straight chain), iso-$C_3H_7$, —$C_4H_9$ (straight chain), iso-$C_4H_9$, tert-$C_4H_9$ or —$C_6H_5$. $R_1$ and $R_2$ also may be different, and when $R_1$ is H, $R_2$ is —$CH_3$, —$C_2H_5$, —$C_3H_7$ (straight chain), iso-$C_3H_7$, —$C_4H_9$ (straight chain), iso-$C_4H_9$, tert-$C_4H_9$ or —$C_4H_9$ (straight chain). When $R_1$ is —$CH_3$ or —$C_2H_5$, $R_2$ is —$C_6H_5$.

[Chemical formula 2]

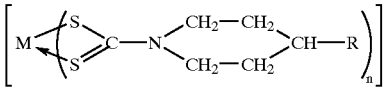

wherein R is H, —$CH_3$ or —$C_2H_5$.

[Chemical formula 3]

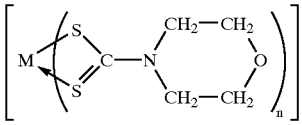

[Chemical formula 4]

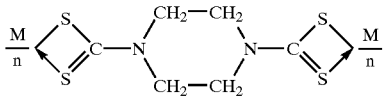

[Chemical formula 5]

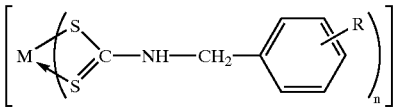

wherein R is ortho-$NO_2$, para-$NO_2$, meta-$OCH_3$,meta-$CH_3$ or meta-$C_2H_5$.

[Chemical formula 6]

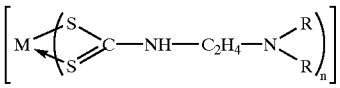

wherein R is —$CH_3$, —$C_2H_5$, —$C_3H_7$ (straight chain) or iso-$C_3H_7$.

[Chemical formula 7]

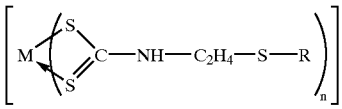

wherein R is a hydrogen atom or an alkyl group of 1–12 carbon atoms.

[Chemical formula 8]

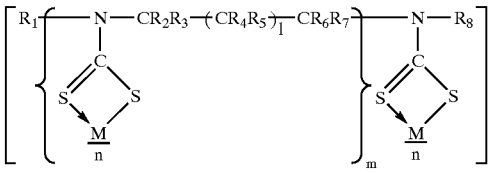

When m=1 and l=0:

$R_1$–$R_3$, and $R_6$–R are H, $R_1$ is —$CH_3$ and $R_2$–$R_3$, $R_6$–$R_8$ are H, $R_1$ is —$C_2H_5$ and $R_2$–$R_3$, $R_6$–$R_8$ are H, $R_1$ is —$C_3H_5$ (straight chain) or iso-$C_3H_5$ and $R_2$–$R_3$, $R_6$–$R_8$ are H.

$R_1$ is —$C_4H_9$ (straight chain), iso-$C_4H_9$ or tert-$C_4H_9$, and $R_2$–$R_3$, $R_6$–$R_8$ are H, $R_2$ and $R_3$ are —$CH_3$ and $R_1$, $R_6$–$R_8$ are H, $R_2$ and $R_6$ are —$CH_3$ and $R_1$, $R_3$, $R_7$–$R_8$ are H, $R_2$, $R_3$, $R_6$ and $R_7$ are —$CH_3$ and $R_1$ and $R_8$ are H, $R_1$ and $R_8$ are —$CH_3$ and $R_2$–$R_3$, $R_6$–$R_7$ are H, $R_1$ and $R_8$ are —$C_2H_5$ and $R_2$–$R_3$, $R_6$–$R_7$ are H, $R_1$ and $R_8$ are —$C_3H_5$ (straight chain) or iso-$C_3H_5$ and $R_2$–$R_3$, $R_6$, $R_7$ are H, $R_1$ and $R_8$ are —$C_4H_9$ (straight chain), iso-$C_4H_9$ or tert-$C_4H_9$ and $R_2$–$R_3$, $R_6$–$R_7$ are H, or $R_2$ and $R_6$ are —$C_6H_5$ and $R_1$, $R_3$, $R_7$–$R_8$ are H.

When m=1 and l=1, $R_1$–$R_6$ are H, or $R_4$ and $R_5$ are —$CH_3$ and $R_1$–$R_3$, $R_6$–$R_7$ are H.

When m=1 and l=2–7, $R_1$–$R_8$ are H.

When m=2–9 and l=0, $R_1$–$R_8$ are H, or $R_2$ is —$CH_3$ and $R_1$, $R_3$, $R_6$–$R_8$ are H.

When m=2–9 and l=1, $R_1$–$R_8$ are H.

[Chemical formula 9]

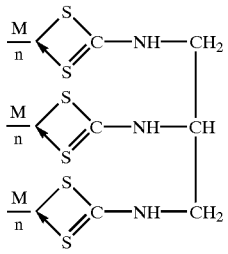

[Chemical formula 10]

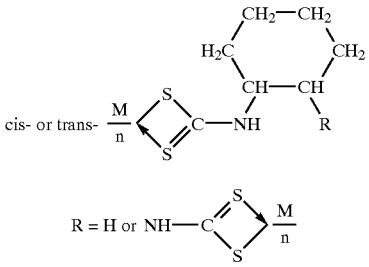

[Chemical formula 11]

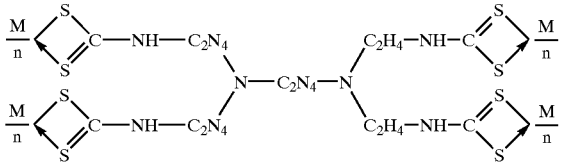

[Chemical formula 12]

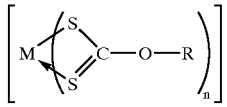

wherein R is a linear or branched alkyl group of 1–12 carbon atoms.

[Chemical formula 13]

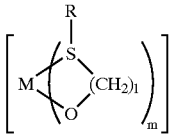

wherein R is H, l=2–3 and m=1, or

R is an alkyl group of 1–12 carbon atoms, l=2–3 and m=2–3.

[Chemical formula 14]

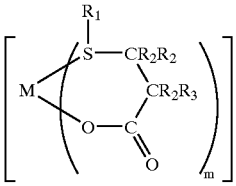

wherein $R_1$–$R_3$ are H and m=1, $R_1$ is an alkyl group of 1–12 carbon atoms, $R_2$–$R_3$ are H and m=2, or $R_1$–$R_2$ are H, $R_3$ is —$NH_2$ and m=2.

[Chemical formula 15]

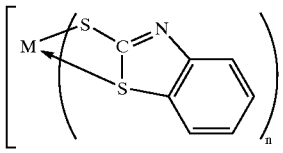

[Chemical formula 16]

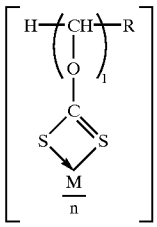

wherein R is H, l=1–6 and n=2–3, or

R is —COOH, l=1–6 and n=2–3.

[Chemical formula 17]

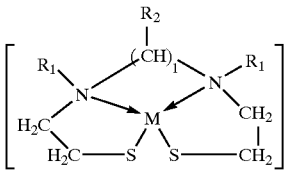

wherein $R_1$ and $R_2$ are H and l=2–12, $R_1$ is H, $R_2$ is —$CH_3$ and l=2–12, $R_1$ is —$C_2H_4S^-$, $R_2$ is H and l=2–12, or $R_1$ is —$C_2H_4S^-$, $R_2$ is $CH_3$ and l=2–12.

[Chemical formula 18]

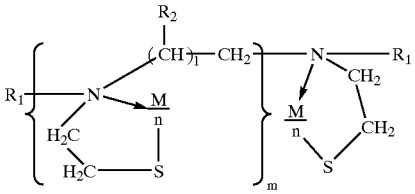

wherein $R_1$ and $R_2$ are H, l=1–2, m=1–6 and n=2–3, or $R_1$ is —$C_2H_4S^-$, $R_2$ is H, m=1–6 and n=1.

[Chemical formula 19]

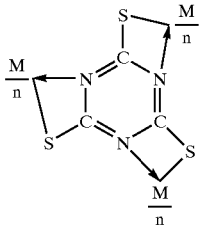

[Chemical formula 20]

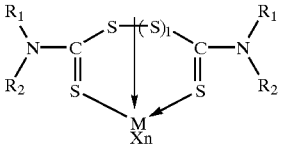

wherein 1 is 0, 1, 2 or 3, $R_1$ and $R_2$ are H, —$CH_3$, —$C_2H_5$, —$C_3H_7$ (straight chain) or iso-$C_3H_7$, $R_1$ is H and $R_2$ is $CH_3$, —$C_2H_5$, —$C_3H_7$ (straight chain) or iso-$C_3H_7$, or $R_1$ is —$C_2H_5$ and $R_2$ is —$C_6H_5$, X is an anionic monodentate ligand and n=2–3.

[Chemical formula 21]

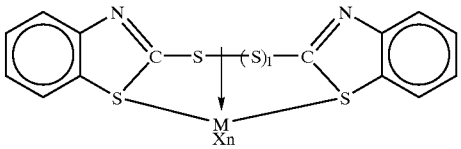

wherein 1 is 0, 1, 2 or 3,

X is an anionic monodentate ligand and n=2–3.

[Chemical formula 22]

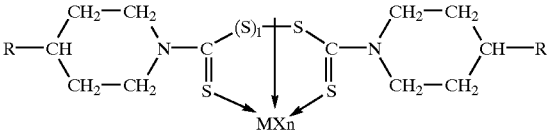

wherein R is H and l=1–4, or

R is an alkyl group of 1–3 carbon atoms and l=1–4,

X is an anionic monodentate ligand and n=2–3.

[Chemical formula 23]

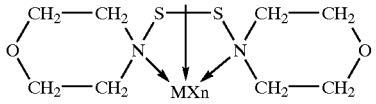

wherein X is an anionic monodentate ligand and n=2–3.

[Chemical formula 24]

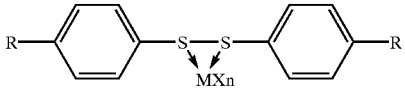

wherein R is H, —$CH_3$, —$OCH_3$, —OH or —$C_6H_5$, X is an anionic monodentate ligand and n=2–3.

[Chemical formula 25]

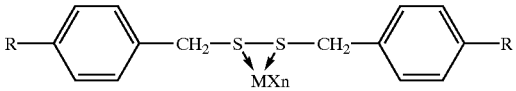

wherein R is H, —$CH_3$, —$OCH_3$ and —OH, X is an anionic monodentate ligand and n=2–3.

[Chemical formula 26]

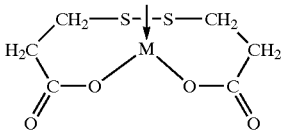

[Chemical formula 27]

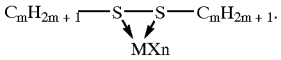

wherein m=1–12, X is an anionic monodentate ligand and n=2–3.

[Chemical formula 28]

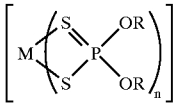

wherein R is an alkyl group (C=1–12).

As clearly seen in chemical structures 1–28, in these metal chelate compounds, at least one coordinating atom is sulfur, which is chelated to at least one metal species selected from among zinc, manganese, iron, molybdenum, tin and antimony. The metal chelate compounds are hydrophobic fine particles, but at pH 8.0–13.0, they disperse in water with anionic or non-ionic surfactants and are maintained as stable dispersions in water. If the metal chelate compounds are instead made minute, they can be suspended for relatively long periods without precipitation, even if a surfactant or the like is not used, and a physical suspension also can be created by stirring or agitation. Thus, an aqueous lubricant can be realized that does not require any oil or organic solvent.

When the suspension or dispersion is coated onto either or both a metal material surface and the molding side of a metal mold, a lubricating film is formed on the coated surface. The lubricating film adheres well to the surface and does not easily peel from the surface during plastic working of the metal material. It also has satisfactory lubricating properties and effectively prevents seizing of the material and the mold. This lubricant has the advantage of adhering well to the coated metal surface as long as no oil is present on that surface, and also has the feature of not requiring preparatory steps, such as degreasing and washing. In addition, the lubricant requires no special management and can be recycled, so that the only management necessary is re-supply of the consumed portion. Stringent washing is not required, even when electron beam welding is performed after plastic working.

A number of methods can be used for the application, and for example, application onto the surface of the material can be accomplished by any desired method, such as immersion of the material in the lubricant, painting with a brush or spraying. For application to the molding side of the mold, the method employed may be painting with a brush, spraying or the like.

The lubricant-coated material or mold may be permitted to stand so that the lubricant may naturally dry, but if necessary, it may be forcibly dried. The method employed for forcibly drying the lubricant may be any desired method, such as exposure to hot air, preheating the material or mold or drying by high-frequency heating. The extent of drying can be adjusted, if necessary, to achieve total dryness or partial dryness. The extent of drying can be adjusted, as desired, by varying the drying temperature and drying time.

The metal chelate compound may be produced in solution instead of preparing the metal chelate compound beforehand and adding it to water. That is, the lubricant used can have one or more chelating agents in which at least one of the coordinating atoms is sulfur, and adding thereto a salt, oxide or hydroxide of one or more metals selected from among zinc, manganese, iron, molybdenum, tin and antimony and an anionic or non-ionic surfactant. This type of lubricant can be used in exactly the same manner.

In the case of the metal chelate compounds represented by chemical structures 1–28, chelate ligands, in which sulfur is a coordinating atom, may be coordinated to all the coordination sites of the metals. Alternatively, chelate ligands, in which sulfur is a coordinating atom, may be coordinated to only some of the coordination sites of the metals, and other ligands, in which sulfur is not a coordinating atom, are coordinated to the remaining coordination sites. Suitable examples of ligands in which sulfur is not a coordinating atom are hydroxide ions, condensed phosphate, polycarboxylic high molecular activators and/or polyoxycarboxylic acid. Chemical structures 1–28 also show compounds in which chelate ligands having sulfur as a coordinating atom, as represented in the structures, are coordinated to only some of the coordination sites of the metals.

When a phosphate film has been formed on the metal surface, and the metal is immersed in an aqueous solution of any of the chelate ligands (the compounds adjacent to M in the structures) represented in chemical structures 1–28, the chelate ligand having sulfur as a coordinating atom coordinates with the zinc ion or iron ion present in the phosphate film to produce a crystalline multi-ligand metal chelate compound on the phosphate film, which results in a lubricating effect.

When a phosphate film has been formed on the metal surface, and the metal is immersed in an aqueous solution of a metal chelate compound in which a chelate ligand having sulfur as a coordinating atom is coordinated to only some of the coordination sites of the metal, while other chelate ligands are coordinated to the remaining coordination sites, a crystalline polynuclear chelate compound is produced on the phosphate film, resulting in a lubricating effect.

When the lubricating film includes two or more different types of metal chelate compounds, their lubricating effects are synergistic, so that a highly satisfactory effect is achieved.

The lubricant described above forms a lubricating film by strong adhesion to surfaces of primarily iron, especially steel and iron alloys, but it can also be used for non-ferrous metals, such as aluminum.

Various additives, such as pH adjusters, viscosity controllers, preservatives, antifoaming agents and the like may also be added to the lubricant. It is particularly preferred to add soluble condensed phosphate salts, fatty acid sodium salts, fatty acid potassium salts, soluble polycarboxylic high molecular activators and/or soluble polyoxycarboxylic acid salts. These compounds increase the dispersability of the metal chelate compound in water, and improve the adhesive strength of the lubricating film to the metal surface.

Experimental examples will now be explained.

EXPERIMENTAL EXAMPLE 1

150 g of zinc bis-(N,N-diethyldithiocarbamate) was added to a prepared solution of 20 g of sodium stearate in 100 ml of warm water and the mixture was gently stirred to produce an aqueous lubricant.

The following examples are analogous as aqueous lubricants to this Experimental Example 1. The metal chelate compound is not limited to zinc bis-(N,N-diethyldithiocarbamate), and it may be replaced with any of the species represented by chemical structures 1–28, such as N,N-dibutyldithiocarbamate oxymolybdenumsulfate.

Sodium stearate was used as the anionic or non-ionic surfactant in this experimental example, but adjustment to pH 8.0–13.0 with any other well-known anionic or non-ionic surfactants, such as sodium salts of fatty acids and/or potassium salts of fatty acids, can effect adequate dispersion of the metal chelate compound in water. A similar aqueous lubricant can be obtained by making the metal chelate compound fine, adding water and stirring it to create a suspension.

EXPERIMENTAL EXAMPLE 2

A 50 g/200 ml aqueous solution of zinc sulfate heptahydrate was added to a 78 g/300 ml aqueous solution of sodium N,N-diethyldithiocarbamate trihydrate, while stirring, to prepare a suspension of zinc bis-(N,N-diethyldithiocarbamate). Separately, a suspension was created by dispersing 100 g of N,N-dibutyldithiocarbamate oxymolybdenumsulfate in a warm solution (500 ml) containing 20 g of sodium stearate, 20 g of sodium tripolyphosphate and 20 g of a polycarboxylic high molecular activator. Both suspensions were mixed together by stirring to obtain an aqueous lubricant.

The following examples are analogous as aqueous lubricants to this Experimental Example 2. In addition to the aqueous solution of sodium N,N-diethyldithiocarbamate trihydrate, the aqueous solution of zinc sulfate hydrate that produces a metal chelate compound may be replaced with another water-soluble zinc salt or zinc hydroxide compound. It may also be replaced with a water-soluble salt of manganese, iron, molybdenum, tin or antimony. Experimental Example 2 differs from Experimental Example 1 primarily in using a metal chelate compound of two or more different metals, and zinc and molybdenum are used here. Any combination of two or more metals from among zinc, manganese, iron, molybdenum, tin and antimony may be used. The chelate ligand used can be any of those represented in chemical structures 1–28.

Sodium tripolyphosphate need not be included, but its addition will improve the dispersability of the metal chelate compound. The polycarboxylic activator also need not be included, but its addition will improve adhesion of the lubricating film to the metal. A soluble polyoxycarboxylic acid salt may be added instead of a polycarboxylic high molecular activator.

EXPERIMENTAL EXAMPLE 3

A solution of 45.3 g of sodium N,N-diethyldithiocarbamate trihydrate and 8.5 g of sodium hydroxide dissolved in 200 ml of water was slowly poured into a 57.8 g/300 ml aqueous solution of zinc sulfate heptahydrate while stirring to prepare a suspension of zinc mono-(N,N-diethyldithiocarbamate)-hydroxoaqua.

Zinc mono-(N,N-diethyldithiocarbamate)-hydroxoaqua has a chelate ligand with sulfur as a coordinating atom strongly coordinated to some of the coordination sites of zinc, and sodium hydroxide ion weakly coordinated to the remaining coordination sites. Zinc mono-(N,N-diethyldithiocarbamate)-hydroxoaqua can be dispersed in water with a sodium fatty acid salt and/or potassium fatty acid salt, such as sodium stearate.

The following examples are analogous as aqueous lubricants to this Experimental Example 3. The chelate ligand having sulfur as a coordinating atom that chelates to some of the coordination sites of the metal can be replaced with any desired ligand represented in chemical structures 1–28. The sodium hydroxide ion that coordinates to the remaining coordination sites can be replaced with any other desired hydroxide ion, except for sulfur.

As in the above experimental examples, soluble condensed phosphate salts, soluble polycarboxylic high molecular activators and/or soluble polyoxycarboxylic acid salts may be added when necessary.

EXPERIMENTAL EXAMPLE 4

18 g/100 ml of sodium tripolyphosphate was slowly poured into a 57.8 g/300 ml aqueous solution of zinc sulfate heptahydrate while stirring to prepare a suspension of a zinc tripolyphosphate crystalline precipitate. 45.3 g/200 ml of sodium N,N-diethyldithiocarbamate trihydrate was then slowly poured into the suspension, while stirring, to give a crystalline precipitate of zinc mono-(N,N-diethyldithiocarbamate)-triphosphate (hereunder, "G").

Separately, a suspension was prepared by dispersing 100 g of N,N-dibutyldithiocarbamate oxymolybdenumsulfate in a solution of 20 g of sodium stearate, 10 g of sodium tripolyphosphate and 12 g of a polycarboxylic activator dissolved in 500 ml of hot water (hereunder, "H"). G and H were mixed together by stirring to obtain a yellow dispersion that was used as a lubricant.

The zinc mono-(N,N-diethyldithiocarbamate)-triphosphate has a chelate ligand, with sulfur as a coordinating atom, strongly coordinated to some of the coordination sites of zinc, and sodium tripolyphosphate weakly coordinated to the remaining coordination sites via an oxygen anion. The species weakly coordinated to the remaining coordination sites via the oxygen anion is not limited to a condensed phosphate, such as sodium tripolyphosphate, and it may be replaced with a polycarboxylic high molecular activator and/or polyoxycarboxylic acid.

Experimental Example 4 differs from Experimental Example 3 primarily in using a metal chelate compound of two or more different metals, and zinc and molybdenum are used here. Alternatively, any combination of two or more metals selected from among zinc, manganese, iron, molybdenum, tin and antimony may be used. For two or more different metal chelate compounds, they may both have chelate ligands, in which sulfur is a coordinating atom, coordinated to some of the coordination sites of the metal, but as explained above, either of the metal chelate compounds may also have a chelate ligand with sulfur as a coordinating atom that coordinates to all the coordination sites of the metal. The chelate ligand used can be any of those represented in chemical structures 1–28.

EXPERIMENTAL EXAMPLE 5

A metal material on which a phosphate film had already been formed was immersed in a warm solution of 5% sodium N,N-diethyldithiocarbamate (pH 10), and the crystalline multi-ligand zinc chelate compound produced on the phosphate film was used as a lubricant.

By adjusting the pH to a range of 6.5–13.5, the sodium N,N-diethyldithiocarbamate (ligand with sulfur as a coordinating atom) coordinates with the zinc ion or iron ion in the phosphate film to produce a crystalline multi-ligand zinc or iron chelate compound on the phosphate film, thus forming a lubricating film. The chelate ligands may be any desired ones represented by chemical structures 1–28.

EXPERIMENTAL EXAMPLE 6

A mixed aqueous solution (150 ml) of 31 g of sodium N,N-diethyldithiocarbamate trihydrate and 5.9 g of sodium hydroxide was slowly poured into 40 g/200 ml of zinc sulfate heptahydrate, while stirring, to prepare a suspension of zinc mono-(N,N-diethyldithiocarbamate)-hydroxoaqua (hereunder, "I") (pH 11.5–12.0). A metal material, on which a phosphate film had already been formed, was immersed in I at 40–50° C. and stirred for 30–60 seconds to produce a crystalline polynuclear zinc chelate on the phosphate film, which was used as the lubricating film.

A crystalline polynuclear zinc chelate can also be disposed on the phosphate film by immersing the metal material with a phosphate film already formed thereon in any of the lubricants obtained in Experimental Examples 1 to 4. The chelate ligand can be any one represented in chemical structures 1–28, and it is particularly preferred for a chelate ligand with sulfur as a coordinating atom to be coordinated to some of the coordination sites of the metal and chelate ligands without sulfur coordinated to the remaining coordination sites. In such cases, the sulfur-containing chelate ligand coordinates with the metal while the non-sulfur-containing chelate ligand reacts with the zinc ions or iron ions in the phosphate film to produce a crystalline polynuclear metal chelate compound.

Each of the lubricants prepared in Examples 1–6 was coated onto the perforated side of a perforated testing billet (for area reduction of 12%: a cylindrical member was used and having an inner diameter of 15 mm, an outer diameter of 29.9 mm and a length of 50 mm), and dried by exposure to 150° C. hot air for 60 seconds. The time required for this treatment was about 2 minutes.

For comparison, a phosphate film was formed on the same type of billet and a metallic soap film was disposed on top of the phosphate film (Comparative Example 1). The time required for this treatment was over 30 minutes.

For further comparison, a working oil (with lubricating adjuvant added) was coated onto the same type of billet (Comparative Example 2). The time required for this treatment was about 30 seconds.

Each of the billets was subjected to a ball-push test. This test measured the load required for plastic deformation of a billet when an iron ball with a larger diameter than the diameter of the perforation in the billet was forcibly pushed through the billet perforation. The lubricating performance was evaluated based upon the surface condition of the inner diameter of the billet. A smaller load indicates more satisfactory lubrication, allowing smoother plastic deformation. The results (maximum loads) are listed in the following table. In the table, the area reductions are the rates of change in the billet perforations before and after deformation, with larger values indicating a higher degree of deformation, i.e. heavy working. It will be appreciated that better lubrication is achieved when the surface condition has no seizing or, where seizing occurs, the length is shorter.

Values in table indicate loads (units: t)

| Area Reduction | 6% | 8% | 10% | 12% | Treatment Time |
|---|---|---|---|---|---|
| Exp. Example 1 | 19.625 | NG | NG | NG | 2 min. |
| Exp. Example 2 | 11.676 | 15.858 | 20.721 | NG | 2 min. |
| Exp. Example 3 | 13.930 | 16.710 | NG | NG | 2 min. |
| Exp. Example 4 | 9.265 | 9.876 | 11.934 | 15.992 | 2 min. |
| Exp. Example 5 | 10.176 | 13.945 | 17.116 | 20.174 | 2 min. |
| Exp. Example 6 | 8.096 | 9.371 | 10.767 | 15.130 | 2 min. |
| Comp. Example 1 | 8.383 | 10.128 | 14.068 | 18.060 | 30 min. |
| Comp. Example 2 | 21.391 | NG | NG | NG | 30 sec. |

In the table, NG indicates seizing between the iron ball and the billet, showing that a satisfactory surface condition was not obtained. Not all of the experimental examples of the invention were suitable for heavy working, but light working was possible in all of the experimental examples, and satisfactory lubricating performance was confirmed in all of the experimental examples, as compared with using oil. Heavy working is also possible by appropriate selection among the lubricants of the invention.

These examples confirm that results comparable to Comparative Example 1 can be obtained with adequate functionality by simple coating and formation of a lubricating film. Because the treatment times were only about 2 minutes, treatment is possible within a very short time. The performance difference was particularly notable in comparison with Comparative Example 2, thus confirming that working is possible by these examples even in cases in which working was not possible by Comparative Example 2.

EFFECT OF THE INVENTION

With the lubricating solution of the invention, effective lubricating films can be formed by a simple application process, which films exhibit performance comparable to that achieved by the troublesome and difficult procedure of forming phosphate films and disposing metallic soap films on the metal object. Because the present invention does not use oil, the problems of working environment contamination and the need for subsequent degreasing treatment do not occur. Because a simple application is sufficient, a solution is also provided to the problems of large equipment requirements and the need to perform simultaneous treatment of large volumes of materials. Apparatus can therefore be installed for formation of lubricating films in the narrow spaces adjacent to the apparatus for plastic working of materials, forming the lubricating films in sequence with the plastic working apparatus cycles without requiring extra storage between the two treatments, so that it becomes possible to shorten lead times.

What is claimed is:

1. An aqueous lubricant comprising an aqueous liquid and at least one multi-ligand metal chelate compound, said compound having the following structure:

at least one metal species selected from the group consisting of zinc, manganese, iron, molybdenum, tin and antimony, the metal species having multiple coordinating sites;

at least one polydentate chelate ligand having sulfur as a coordinating atom, the at least one ligand coordinating to at least one of the multiple coordination sites of the at least one metal species and having a formula selected from the group consisting of the following formulas (A) to (S):

(A)

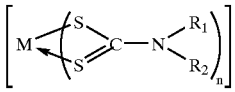

wherein $R_1$ is the same as or different from $R_2$.

wherein when $R_1$ and $R_2$ are the same, each of $R_1$ and $R_2$ is H, —$CH_3$, —$C_2H_5$, —$C_3H_7$ (straight chain), iso-$C_3H_7$, —$C_4H_9$ (straight chain), iso-$C_4H_9$, tert-$C_4H_9$ or —$C_6H_5$, and wherein when $R_1$ and $R_2$ are different, $R_1$ is H and $R_2$ is —$CH_3$, —$C_2H_5$, —$C_3H_7$ (straight chain), iso-$C_3H_7$, iso-$C_4H_9$, tert-$C_4H_9$ or —$C_4H_9$ (straight chain); or $R_1$ is —$CH_3$ or —$C_2H_5$ and $R_2$ is —$C_6H_5$, wherein when M is zinc, molybdenum, tin or antimony, n is 1, and wherein when M is manganese or iron, n is 1 or 2, (B)

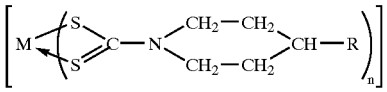

wherein R is H, —$CH_3$ or —$C_2H_5$, and wherein when M is zinc, molybdenum, tin or antimony, n is 1, and wherein when M is manganese or iron, n is 1 or 2, (C)

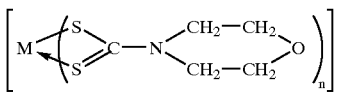

wherein when M is zinc, molybdenum, tin or antimony, n is 1, and wherein when M is manganese or iron, n is 1 or 2, (D)

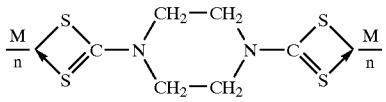

wherein when M is zinc, molybdenum, tin or antimony, n is 1, and wherein when M is manganese or iron, n is 1 or 2, (E)

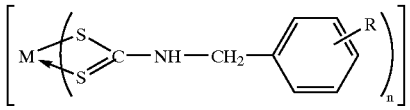

wherein R is ortho-$NO_2$, para-$NO_2$, meta-$OCH_3$, meta-$CH_3$ or meta-$C_2H_5$, and wherein when M is zinc, molybdenum, tin or antimony, n is 1, and wherein when M is manganese or iron, n is 1 or 2, (F)

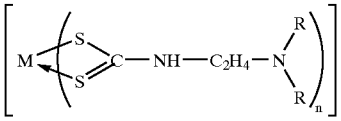

wherein R is —$CH_3$, —$C_2H_5$, —$C_3H_7$ (straight chain) or iso-$C_3H_7$, and wherein when M is zinc, molybdenum, tin or antimony, n is 1, and wherein when M is manganese or iron, n is 1 or 2, (G)

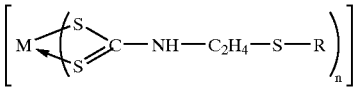

wherein R is H or an alkyl group of 1–12 carbon atoms, and wherein when M is zinc, molybdenum, tin or antimony, n is 1, and wherein when M is manganese or iron, n is 1 or 2, (H)

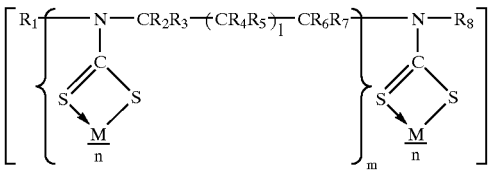

wherein when m is 1 and l is 0, $R_1$–$R_3$ and $R_6$–$R_8$ are H; or $R_1$ is —$CH_3$ and $R_2$–$R_3$, $R_6$–$R_8$ are H; or $R_1$ is —$C_2H_5$ and $R_2$–$R_3$, $R_6$–$R_8$ are H; or $R_1$ is —$C_3H_5$ (straight chain) or iso-$C_3H_5$ and $R_2$–$R_3$, $R_6$–$R_8$ are H; or $R_1$ is —$C_4H_9$ (straight chain), iso-$C_4H_9$ or tert-$C_4H_9$, and $R_2$–$R_3$, $R_6$–$R_8$ are H; or $R_2$ and $R_3$ are —$CH_3$ and $R_1$, $R_6$–$R_8$ are H; or $R_2$ and $R_6$ are —$CH_3$ and $R_1$, $R_3$, $R_7$–$R_8$ are H; or $R_2$, $R_3$, $R_6$ and $R_7$ are —$CH_3$ and $R_1$ and $R_8$ are H; or $R_1$ and $R_8$ are —$CH_3$ and $R_2$–$R_3$, $R_6$–$R_7$ are H; or $R_1$ and $R_8$ are —$C_2H_5$ and $R_2$–$R_3$, $R_6$–$R_7$ are H; or $R_1$ and $R_8$ are —$C_3H_5$ (straight chain) or iso-$C_3H_5$ and $R_2$–$R_3$, $R_6$, $R_7$ are H; or $R_1$ and $R_8$ are —$C_4H_9$ (straight chain), iso-$C_4H_9$ or tert-$C_4H_9$ and $R_2$–$R_3$, $R_6$–$R_7$ are H; or $R_2$ and $R_6$ are —$C_6H_5$ and $R_1$, $R_3$, $R_7$–$R_8$ are H, and wherein when m is 1 and l is 1, $R_1$–$R_8$ are H; or $R_4$ and $R_5$ are —$CH_3$ and $R_1$–$R_3$, $R_6$–$R_8$ are H, and wherein when m is 1 and l is selected from 2, 3, 4, 5, 6 and 7, $R_1$–$R_8$ are H, and wherein when m is selected from 2, 3, 4, 5, 6, 7, 8 and 9 and l is 0, $R_1$–$R_8$ are H; or $R_2$ is —$CH_3$ and $R_1$, $R_3$, $R_6$–$R_8$ are H, and wherein when m is selected from 2, 3, 4, 5, 6, 7, 8 and 9 and l is 1, $R_1$–$R_8$ are H, and wherein when M is zinc, molybdenum, tin or antimony, n is 1, and wherein when M is manganese or iron, n is 1 or 2, (I)

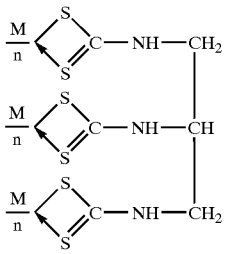

wherein when M is zinc, molybdenum, tin or antimony, n is 1, and wherein when M is manganese or iron, n is 1 or 2, (J)

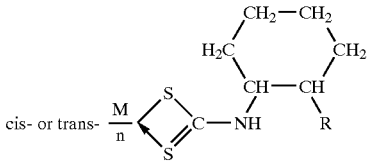

wherein

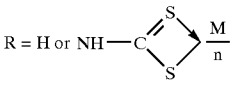

and wherein when M is zinc, molybdenum, tin or antimony, n is 1, and wherein when M is manganese or iron, is 1 or 2, (K)

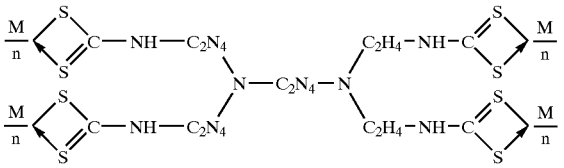

wherein when M is zinc, molybdenum, tin or antimony, n is 1, and wherein when M is manganese or iron, n is 1 or 2, (L)

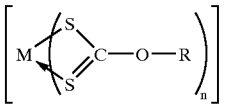

wherein R is a linear or branched alkyl group of 1–12 carbon atoms, and wherein when M is zinc, molybdenum, tin or antimony, n is 1, and wherein when M is manganese or iron, n is 1 or 2, (M)

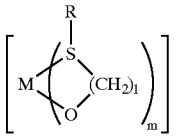

wherein R is H and l is selected from 2 and 3; or R is an alkyl group of 1–12 carbon atoms and l is selected from 2 and 3, and wherein when M is zinc, molybdenum, tin or antimony, m is 1, and wherein when M is manganese or iron, m is 1 or 2, (N)

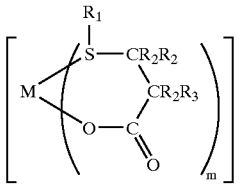

wherein $R_1$–$R_3$ are H; or $R_1$ is an alkyl group of 1–12 carbon atoms, $R_2$–$R_3$ are H; or $R_1$–$R_2$ are H, $R_3$ is —$NH_2$, and wherein when M is zinc, molybdenum, tin or antimony, m is 1, and wherein when M is manganese or iron, m is 1 or 2, (O)

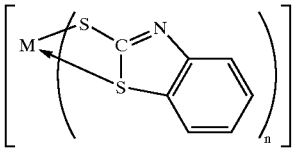

wherein when M is zinc, molybdenum, tin or antimony, n is 1, and wherein when M is manganese or iron, n is 1 or 2, (P)

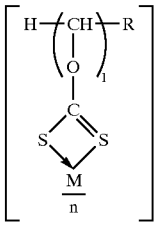

wherein l is selected from 1, 2, 3, 4, 5 and 6, R is H or —COOH, and wherein when M is zinc, molybdenum, tin or antimony, n is 1, and wherein when M is manganese or iron, n is 1 or 2, (Q)

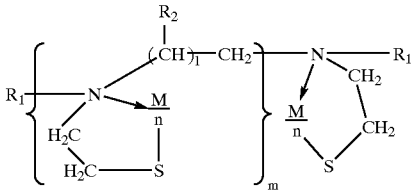

wherein $R_1$ and $R_2$ are H, l is 1 or 2, m is selected from 1, 2, 3, 4, 5 and 6; or $R_1$ is $—C_2H_4S^-$, $R_2$ is H, l is 1 or 2, m is selected from 1, 2, 3, 4, 5 and 6, and wherein when M is zinc, molybdenum, tin or antimony, m is 1, and wherein when M is manganese or iron, m is 1 or 2, (R)

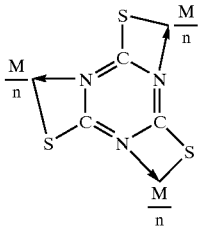

wherein when M is zinc, molybdenum, tin or antimony, m is 1, and wherein when M is manganese or iron, m is 1 or 2, and (S)

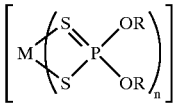

wherein R is an alkyl group having one to twelve carbon atoms, and wherein when M is zinc, molybdenum, tin or antimony, n is 1, and wherein when M is manganese or iron, n is 1 or 2; and at least one condensed phosphate and/or polyoxycarboxylic acid coordinated to the remaining coordination sites.

2. An aqueous lubricant as in claim 1, wherein the multi-ligand metal chelate compound is suspended or dispersed in an aqueous liquid.

3. An aqueous lubricant as in claim 2, further comprising a soluble condensed phosphate salt, a fatty acid sodium salt, a fatty acid potassium salt and/or a soluble polycarboxylic acid salt.

4. A method of forming a lubricating film on a metal material comprising:

forming a phosphate film on the metal material, the phosphate film comprising zinc and/or iron ions; and immersing the metal material in the aqueous lubricant of claim 2, whereby a ligand not having sulfur as a coordinating atom reacts with the zinc and/or iron ions in said phosphate film.

5. A method as in claim 4, wherein a crystalline polynuclear metal chelate compound is formed on the phosphate film.

6. A method of forming a lubricating film on a metal material comprising:

forming a phosphate film on the metal material, the phosphate film comprising zinc and/or iron ions; and immersing the metal material in the aqueous lubricant of claim 3, whereby a ligand not having sulfur as a coordinating atom reacts with the zinc and/or iron ions in said phosphate film.

7. A method as in claim 6, wherein a crystalline polynuclear metal chelate compound is formed on the phosphate film.

8. A method of forming a lubricating film on at least one surface selected from a metal material surface and a metal mold surface, comprising applying the aqueous lubricant of claim 2 to the at least one surface.

9. A method as in claim 8, further comprising drying the at least one surface after application of the aqueous lubricant.

10. A method as in claim 9, further comprising plastically working the metal material.

11. A method as in claim 10, further comprising contacting the dried aqueous lubricant with a soluble condensed phosphate salt and/or a soluble polyoxycarboxylic acid salt before plastically working the metal material.

12. A method of forming a lubricating film on at least one surface selected from a metal material surface and a metal mold surface, comprising applying the aqueous lubricant of claim 3 to the at least one surface.

13. A method as in claim 12, further comprising drying the at least one surface after application of the aqueous lubricant.

14. A method as in claim 13, further comprising plastically working the metal material.

15. A method as in claim 14, further comprising contacting the dried aqueous lubricant with a soluble condensed phosphate salt and/or a soluble polyoxycarboxylic acid salt before plastically working the metal material.

16. An aqueous lubricant comprising an aqueous liquid and at least one compound, said compound having the following structure:

at least one multi-valent metal ion selected from the group consisting of zinc, manganese, iron, molybdenum, tin and antimony, at least one polydentate chelate ligand having at least two sulfur atoms as coordinating atoms, the at least two sulfur coordinating atoms being bound to the at least one metal ion, the at least one ligand having a formula selected from the group consisting of the following formulas (A) to (L), (O), (P) and (S):

(A)

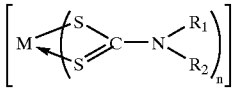

wherein $R_1$ is the same as or different from $R_2$, wherein when $R_1$ and $R_2$ are the same, each of $R_1$ and $R_2$ is H, —$CH_3$, —$C_2H_5$, —$C_3H_7$ (straight chain), iso-$C_3H_7$, —$C_4H_9$ (straight chain), iso-$C_4H_9$, tert-$C_4H_9$ or —$C_6H_5$, and wherein when $R_1$ and $R_2$ are different, $R_1$ is H and $R_2$ is —$CH_3$, —$C_2H_5$, —$C_3H_7$ (straight chain), iso-$C_3H_7$, iso-$C_4H_9$, tert-$C_4H_9$ or —$C_4H_9$ (straight chain); or $R_1$ is —$CH_3$ or —$C_2H_5$ and $R_2$ is —$C_6H_5$, wherein when M is zinc, molybdenum, tin or antimony, n is 1, and wherein when M is manganese or iron, n is 1 or 2, (B)

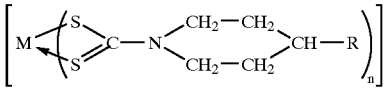

wherein R is H, —$CH_3$ or —$C_2H_5$, and wherein when M is zinc, molybdenum, tin or antimony, n is 1, and wherein when M is manganese or iron, n is 1 or 2, (C)

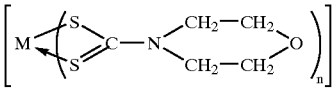

wherein when M is zinc, molybdenum, tin or antimony, n is 1, and wherein when M is manganese or iron, n is 1 or 2, (D)

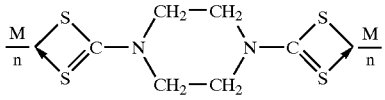

wherein when M is zinc, molybdenum, tin or antimony, n is 1, and wherein when M is manganese or iron, n is 1 or 2, (E)

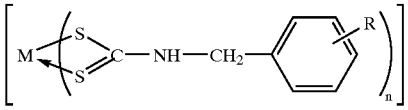

wherein R is ortho-$NO_2$, para-$NO_2$, meta-$OCH_3$, meta-$CH_3$ or meta-$C_2H_5$, and wherein when M is zinc, molybdenum, tin or antimony, n is 1, and wherein when M is manganese or iron, n is 1 or 2, (F)

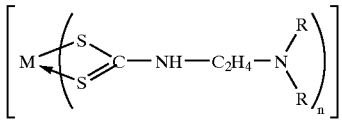

wherein R is —$CH_3$, —$C_2H_5$, —$C_3H_7$ (straight chain) or iso-$C_3H_7$, and wherein when M is zinc, molybdenum, tin or antimony, n is 1, and wherein when M is manganese or iron, n is 1 or 2, (G)

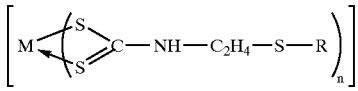

wherein R is H or an alkyl group of 1–12 carbon atoms, and wherein when M is zinc, molybdenum, tin or antimony, n is 1, and wherein when M is manganese or iron, n is 1 or 2, (H)

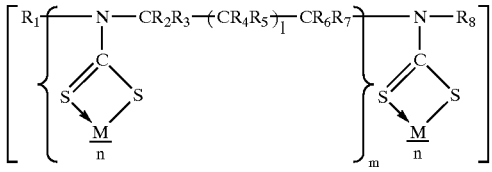

wherein when m is 1 and l is 0, $R_1$–$R_3$ and $R_6$–$R_8$ are H; or $R_1$ is —$CH_3$ and $R_2$–$R_3$, $R_6$–$R_8$ are H; or $R_1$ is —$C_2H_5$ and $R_2$–$R_3$, $R_6$–$R_8$ are H; or $R_1$ is —$C_3H_5$ (straight chain) or iso-$C_3H_5$ and $R_2$–$R_3$, $R_6$–$R_8$ are H; or $R_1$ is —$C_4H_9$ (straight chain), iso-$C_4H_9$ or tert-$C_4H_9$, and $R_2$–$R_3$, $R_6$–$R_8$ are H; or $R_2$ and $R_3$ are —$CH_3$ and $R_1$, $R_6$–$R_8$ are H; or $R_2$ and $R_6$ are —$CH_3$ and $R_1$, $R_3$, $R_7$–$R_8$ are H; or $R_2$, $R_3$, $R_6$ and $R_7$ are —$CH_3$ and $R_1$ and $R_8$ are H; or $R_1$ and $R_8$ are —$CH_3$ and $R_2$–$R_3$, $R_6$–$R_7$ are H; or $R_1$ and $R_8$ are —$C_2H_5$ and $R_2$–$R_3$, $R_6$–$R_7$ are H; or $R_1$ and $R_8$ are —$C_3H_5$ (straight chain) or iso-$C_3H_5$ and $R_2$–$R_3$, $R_6$, $R_7$ are H; or $R_1$ and $R_8$ are —$C_4H_9$ (straight chain), iso-$C_4H_9$ or tert-$C_4H_9$ and $R_2$–$R_3$, $R_6$–$R_7$ are H; or $R_2$ and $R_6$ are —$C_6H_5$ and $R_1$, $R_3$, $R_7$–$R_8$ are H, and wherein when m is 1 and l is 1, $R_1$–$R_8$ are H; or $R_4$ and $R_5$ are —$CH_3$ and $R_1$–$R_3$, $R_6$–$R_8$ are H, and wherein when m is 1 and l is selected from 2, 3, 4, 5, 6 and 7, $R_1$–$R_8$ are H, and wherein when m is selected from 2, 3, 4, 5, 6, 7, 8 and 9 and l is 0, $R_1$–$R_8$ are H; or $R_2$ is —$CH_3$ and $R_1$, $R_3$, $R_6$–$R_8$ are H, and wherein when m is selected from 2, 3, 4, 5, 6, 7, 8 and 9 and l is 1, $R_1$–$R_8$ are H, and wherein when M is zinc, molybdenum, tin or antimony, n is 1, and wherein when M is manganese or iron, n is 1 or 2, (I)

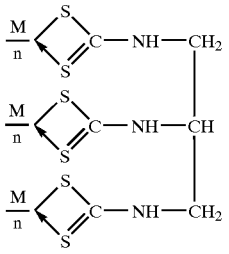

wherein when M is zinc, molybdenum, tin or antimony, n is 1, and wherein when M is manganese or iron, n is 1 or 2, (J)

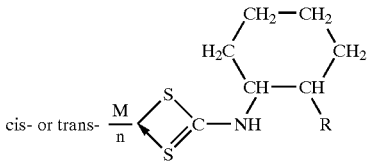

wherein

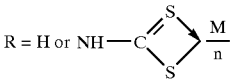

and wherein when M is zinc, molybdenum, tin or antimony, n is 1, and wherein when M is manganese or iron, n is 1 or 2, (K)

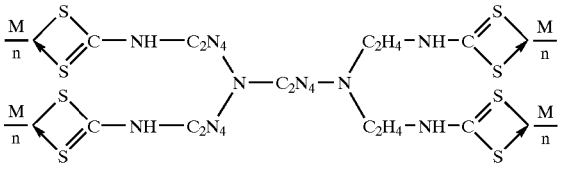

wherein when M is zinc, molybdenum, tin or antimony, n is 1, and wherein when M is manganese or iron, n is 1 or 2, (L)

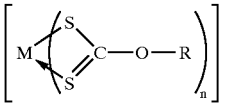

wherein R is a linear or branched alkyl group of 1–12 carbon atoms, an wherein when M is zinc, molybdenum, tin or antimony, n is 1, and wherein when M is manganese or iron, n is 1 or 2, (O)

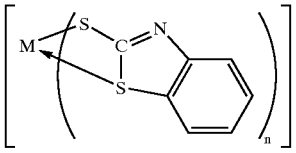

wherein when M is zinc, molybdenum, tin or antimony, n is 1, and wherein when M is manganese or iron, n is 1 or 2, and (P)

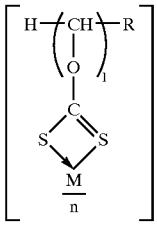

wherein l is selected from 1, 2, 3, 4, 5 and 6, R is H or —COOH, and wherein when M is zinc, molybdenum, tin or antimony, n is 1, and wherein when M is manganese or iron, n is 1 or 2, and (S)

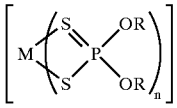

wherein R is an alkyl group having one to twelve carbon atoms, and wherein when M is zinc, molybdenum, tin or antimony, n is 1, and wherein when M is manganese or iron, n is 1 or 2; and at least one condensed phosphate and/or polyoxycarboxylic acid coordinated with the metal.

17. An aqueous lubricant as in claim 16, wherein the compound is suspended or dispersed in an aqueous liquid.

18. An aqueous lubricant as in claim 17, further comprising a soluble condensed phosphate salt, a fatty acid sodium salt, fatty acid potassium salt and/or a soluble polyoxycarboxylic acid salt.

19. An aqueous lubricant as in claim 18, further comprising an anionic surfactant or a non-ionic surfactant, wherein the aqueous lubricant has a pH between 8–13.

20. A lubricant as in claim 16, wherein the at least one metal ion is a zinc ion and the at least two other groups bound to the zinc ion are selected from condensed phosphate and polyoxycarboxylic acid.

21. A lubricant as in claim 20, wherein the condensed phosphate is bound to the zinc ion and the condensed phosphate is tripolyphosphate.

22. A lubricant as in claim 21, wherein the polydentate chelate ligand is N,N-diethyldithiocarbamate.

23. A lubricant as in claim 16, wherein the polydentate chelate ligand is N,N-diethyldithiocarbamate.

24. A lubricant as in claim 23, wherein the condensed phosphate is bound to the at least one metal ion and the condensed phosphate is tripolyphosphate.

25. A lubricant as in claim 16, comprising two multivalent metal ions.

26. A lubricant as in claim 25, wherein the condensed phosphate is tripolyphosphate.

27. A lubricant as in claim 26, wherein the polydentate chelate ligand is N,N-diethyldithiocarbamate.

28. A method of forming a lubricating film on a metal surface, comprising applying the aqueous lubricant of claim 16 to the metal surface and drying the metal surface after application of the aqueous lubricant.

29. A method of forming a lubricating film on a metal surface, comprising applying the aqueous lubricant of claim 21 to the metal surface and drying the metal surface after application of the aqueous lubricant.

30. A method of forming a lubricating film on a metal surface, comprising applying the aqueous lubricant of claim 27 to the metal surface and drying the metal surface after application of the aqueous lubricant.

31. A lubricant as in claim 1, wherein the at least one metal species is selected from the group consisting of divalent zinc, divalent manganese, trivalent manganese, divalent iron, trivalent iron, tetravalent molybdenum, pentavalent molybdenum, divalent tin, tetravalent tin, trivalent antimony, and pentavalent antimony.

32. A lubricant as in claim 2, further comprising an anionic or non-ionic surfactant, wherein the aqueous lubricant has a pH between 8.0 and 13.0.

33. A lubricant as in claim 32, further comprising a soluble condensed phosphate salt, a fatty acid sodium salt, a fatty acid potassium salt and/or a soluble polyoxycarboxylic acid salt.

34. A lubricant as in claim 33, wherein the lubricant is substantially free of oil and organic solvents.

35. A method for forming a lubricating film on a metal surface, comprising applying the lubricant of claim 34 to the metal surface and drying the metal surface.

36. A method as in claim 35, wherein the metal surface is substantially free of oil.

37. A method as in claim 36, further comprising plastically deforming the metal.

38. A lubricant as in claim 1, wherein the at least one metal species is a zinc ion.

39. A lubricant as in claim 38, wherein the at least one condensed phosphate is tripolyphosphate and the tripolyphosphate is bound to the zinc ion.

40. A lubricant as in claim 1, wherein the at least one ligand is N,N-diethyldithiocarbamate.

* * * * *